United States Patent [19]

Schmidt et al.

[11] Patent Number: 5,029,705

[45] Date of Patent: Jul. 9, 1991

[54] SELECTIVELY CONFIGURABLE PACKAGE FOR RETAINING SEPARATED ITEMS

[75] Inventors: James J. Schmidt, Oakdale, Calif.; Wilton M. Connor, Charlotte, N.C.

[73] Assignee: Schmidt-Conner Joint Venture Group, Charlotte, N.C.

[21] Appl. No.: 404,745

[22] Filed: Sep. 8, 1989

[51] Int. Cl.[5] ..... B65D 85/20

[52] U.S. Cl. ..... 206/333; 206/45.31; 206/45.33; 206/470; 206/471; 220/507

[58] Field of Search ..... 206/45.31, 45.33, 45.34, 206/333, 445, 461, 463, 467, 468–471, 806; 229/2.5 R; 220/337, 339, 23.4, 23.6, 23.8

[56] References Cited

U.S. PATENT DOCUMENTS

| | | | |
|---|---|---|---|
| 2,575,192 | 11/1951 | Shepard | 229/2.5 R |
| 2,858,224 | 10/1958 | Darrah | 206/602 X |
| 3,053,023 | 9/1962 | Watts, Jr. | 260/463 X |
| 3,122,441 | 2/1964 | Smith | 206/45.34 X |
| 3,164,478 | 1/1965 | Bostrom | 206/445 X |
| 3,245,528 | 4/1966 | Holley | 220/23.6 X |
| 3,358,824 | 12/1967 | Stagnitto | 206/461 X |
| 3,389,825 | 6/1968 | Whiteford | 220/23.4 |
| 3,552,595 | 1/1971 | Gerner et al. | 220/339 X |
| 3,605,374 | 9/1971 | Mueller et al. | 229/2.5 R |
| 3,659,706 | 5/1972 | Serrell | 220/23.4 X |
| 3,776,375 | 12/1975 | Rohdin | 206/45.34 |
| 3,868,017 | 2/1975 | Carreth | 206/491 |
| 4,202,464 | 5/1980 | Mohs et al. | 220/339 |
| 4,749,082 | 6/1988 | Gerdiner et al. | 206/45.31 X |
| 4,842,143 | 6/1989 | McKee, Sr. et al. | 206/463 X |
| 4,896,770 | 1/1999 | Calcerano et al. | 206/333 |

FOREIGN PATENT DOCUMENTS

| | | | |
|---|---|---|---|
| 2557540 | 6/1977 | Fed. Rep. of Germany | 206/461 |
| 2029360 | 3/1980 | United Kingdom | 206/463 |

*Primary Examiner*—Bryon P. Gehman

*Attorney, Agent, or Firm*—Shefte, Pinckney & Sawyer

[57] ABSTRACT

A package for retaining and displaying a plurality of cylindrical items in separated compartments as formed from a pair of compatibly configured plastic clam shells secured to one another. The plastic clam shells define a front package portion having a plurality of cylindrical item receptacles and a rear package portion having another plurality of cylindrical item receptacles. The front and rear package portions are interconnected to permit predetermined movement of the front and rear package portions relative to one another between a first display position in which the front and rear package portions are disposed in generally superimposed, adjacent relation to one another and a second access position in which the front and rear package portions are substantially displaced from one another to permit ready access to the cylindrical items retained in the item receptacles.

9 Claims, 6 Drawing Sheets

SELECTIVELY CONFIGURABLE PACKAGE FOR RETAINING SEPARATED ITEMS

BACKGROUND OF THE INVENTION

The present invention relates to a selectively configurable package for retaining a plurality of separated items and, more particularly, to a selectively configurable package for retaining a plurality of separated items in a retail display disposition while also permitting ready access to the packaged items.

A wide variety of consumer products are sold in packages or containers having multiple units of the product contained therein, and in which each individual unit of the product is labeled or embossed with trademarks and/or trade dress elements that are visible through the clear packaging materials. For example, various chemical batteries for use in cameras, home appliances, audio equipment and the like, are typically individually labeled with a trademark of the battery manufacturer. In view of the considerable advertising and promotional expenditures by the manufacturers of such products which are designed to stimulate consumer recognition of their trademarks, considerable product recognition and impulse buying benefits accrue when the individually labeled products can be displayed in an attractive retail display in such a manner that the trademarks are easily and readily recognizable by potential consumers. To this end, clear plastic packaging has shown itself to be ideal for retaining such individually labeled items in a retail display disposition in which the trademark and/or trade dress of the product is optimally positioned to catch the attention of potential consumers.

The development of stronger clear plastic packaging materials now enables product manufacturers to group together several like individual products, or even dissimilar individual products, as a single display unit which can be readily mounted on conventional display racks and the like in retail outlets. The clear plastic packaging permits potential consumers to readily assure themselves that the packaged product is the particular one for their needs, and benefits the product manufacturers by allowing the individually labeled products to serve as a retail display for presenting the trademarks to the consumer without requiring separate labeling of the package itself.

The clear plastic packaging is commonly produced in one of two configurations. In one configuration, a so-called "blister pack" package is formed by molding of a pair of compatibly designed clear plastic package portions which are adapted to retain a number of the individually labeled products within the one or more compartments formed by the two portions when they are connected together by heat sealing or other treatment. The other common type of packaging formed of clear plastic includes a cardboard backing to which a clear plastic blister is adhered with the individual items retained within a compartment formed between the blister plastic and the cardboard packing.

While both blister type plastic packaging configurations have enabled product manufacturers to present their products in a display disposition, such packages have not yet fully satisfied the consumer's preference for packages which, in addition to their aesthetic or retail display appeal, also facilitate access to, and removal of, the individual items within the package. For example, in blister type plastic packages in which the individual items are not retained separately from one another, the breaking or rupturing of the plastic container to gain access to one of the individual items typically compromises the integrity of the package with respect to other items. Accordingly, once the consumer has removed one of the individual items, steps must be taken to insure that the other individual items do not fall or spill out of the package, and the remaining items are no longer encapsulated, whereby they are exposed to ambient conditions and whatever harmful effects that may result therefrom.

SUMMARY OF THE INVENTION

Briefly described, the present invention provides a package for retaining and displaying a plurality of items in separated compartments, comprising a pair of plastic shells adapted to be cooperatively engaged with one another, the plastic shells forming, in their cooperatively engaged disposition, a front item receptacle, a rear item receptacle, a connecting portion interconnecting the front and rear item receptacles, and a retaining portion. The interconnecting portion permits predetermined movement of the front and rear receptacles relative to one another between a first display position in which they are disposed in generally superposed, adjacent relation to one another, and a second access position in which they are substantially displaced from one another to permit ready access to both the front and rear receptacles. The retaining portion selectively maintains the front and rear receptacles at the first display position, and the package also includes an arrangement for securing the plastic shells to one another in the cooperatively engaged disposition thereof.

Preferably, the retaining portion includes a slot and a tab portion, the tab portion being selectively insertable into the slot to selectively maintain the front and rear receptacles at the first display position. The front item receptacle and the rear item receptacle each define a generally cylindrical inner volume for receiving an item therein. In one preferred embodiment, the package includes a plurality of perforations for permitting detachment of the front item receptacle from the rear item receptacle, the perforations being disposed between the front and rear item receptacles. Also, the package preferably includes a hanging slot for hanging the package from a retail display rack.

The interconnecting portion preferably includes a generally planar portion adapted to rest on a surface, such generally planar portion cooperating with the retaining portion to permit the package to be generally self-standing on a surface. Also, a stabilizing leg portion is formed on the rear item receptacle for stabilizing the package. Preferably, a selected one of the front item receptacle and the rear item receptacle includes an alignment leg for engaging the outer periphery of the other of the selected front item receptacles and the rear item receptacle to enhance the stability of the package in its the first display position.

According to one aspect of the present invention, a package for retaining a plurality of items in separated compartments includes a front package portion having a plurality of discrete item receptacles, each item receptacle for retaining at least one item and at least one of the item receptacles retaining a selected item in a predetermined orientation, and includes a rear package portion having a plurality of discrete receptacles, each item receptacle for retaining at least one item and at least one of the item receptacles retaining a selected item in a predetermined orientation and support means. The support element is connected to the front and rear package portions for selectively supporting and maintaining the front and rear package portions in generally superposed, adjacent relation with one another with the selected items of the front and rear package portions being generally aligned with one another.

According to another aspect of the present invention, the invention provides a package for retaining and displaying a plurality of items, the package including a first plurality of tubular compartments having individual axes with each first compartment retaining at least one item in a storage disposition, and a second plurality of tubular compartments having individual axes with each second compartment retaining at least one item in a storage disposition, and connecting portions for connecting the compartments to one another. The connecting portions maintain the first plurality of the compartments with their axes parallel to one another and defining a first plane, and maintain the second plurality of the compartments with their axes parallel to one another and defining a second plane. The connecting portions normally maintain the first and second compartments relative to one another such that the first and second planes are substantially parallel to one another, and selectively permits the first and second plurality of containers to move relative to one another such that the first and second planes are arranged substantially coplanar.

The package of the present invention can be adapted to contain a large variety of products, and it is particularly useful in packaging batteries used in consumer electronic products (e.g. audio equipment). In this application, the individual compartment of the packaging may be formed with a cylindrical shape to receive the individual cylindrical batteries, and the compartments are arranged so that, at the display position, the batteries are presented in an attractive and eye-catching fashion with their axes being parallel to one another.

DETAILED DESCRIPTION OF THE PREFERRED EMBODIMENTS

Figure 3:
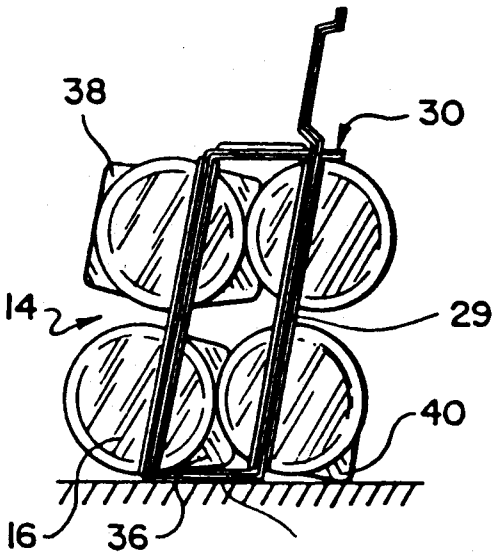
FIG. 3 is a side elevational view of the package shown in FIG. 1.

In FIGS. 1–7, one embodiment of a package 10 constructed in accordance with the present invention is illustrated. The package 10 includes a front package portion 14 having a pair of discrete item receptacles 16 and a rear package portion 18 having a pair of discrete item receptacles 20, each item receptacle 16, 20 being formed to retain one item 12 in a predetermined orientation with respect to the item receptacle and separated from the items retained by the other item receptacles. The package 10 further includes a support portion 22 which connects the front package portion 14 and the rear package portion 18 to one another. The support portion 22 supports and maintains the front and rear package portions in generally superposed, adjacent relation with one another with the retained items 12 generally aligned with one another in the display disposition of the package 10.

Figure 7:
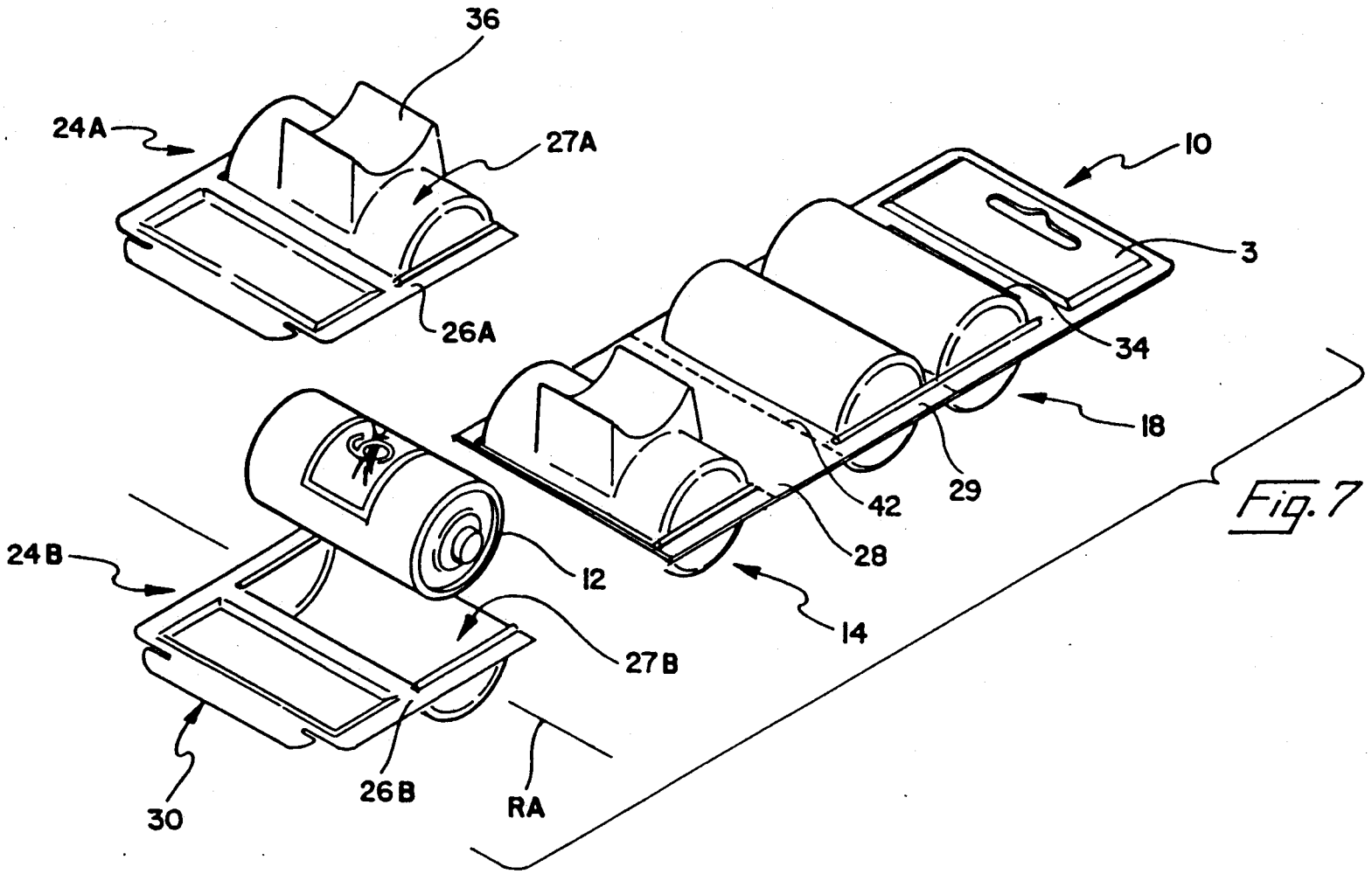
FIG. 7 is a perspective view of the package shown in FIG. 4, and showing one of the package compartments removed from the remainder of the package to permit access to the individual items contained therein.

The front package portion 14, the rear package portion 18 and the support portion 22 can be constructed as discrete components which are interconnected with one another as appropriate. Preferably, however, the front package portion 14, the rear package portion 18 and the support portion 22 are formed as a single unit by a pair of plastic shells 24A, 24B secured to one another in a cooperatively engaged disposition. In this preferred construction, the support portion 22 includes all those portions of the plastic shells 24A, 24B which extend around the peripheries of the item receptacle 16, 20 as well as portions of the shells which interconnect the front and rear package portions and which selectively couple the front and rear package portions to one another. Each plastic shell 24A, 24B is formed by a conventional plastic molding process and is preferably formed of clear plastic. Thus, as best seen in FIG. 7, each plastic shell 24A, 24B is formed with generally planar engagement face 26A, 26B, respectively, arranged in facing contact and a plurality of open recesses 27A, 27B, respectively, spaced from one another by the engagement faces 26A, 26B. Additionally, the shells 24A and 24B each include a border portion 29 extending peripherally thereabout around the respective recesses 27A, 27B. The plastic shells 24A, 24B are secured to one another by appropriate conventional securement means, such as heat sealing of the portions of the shells 24A and 24B which are in contact with each other.

Figure 5:
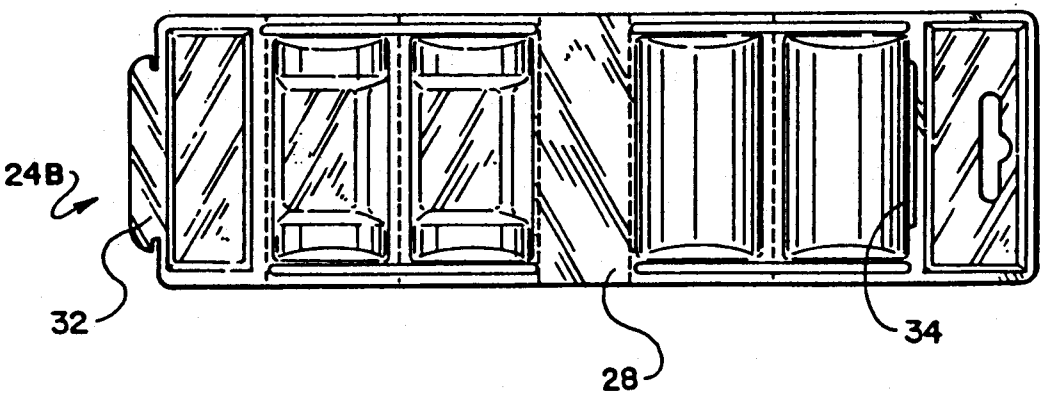
FIG. 5 is a top plan view of FIG. 4.
Figure 6:
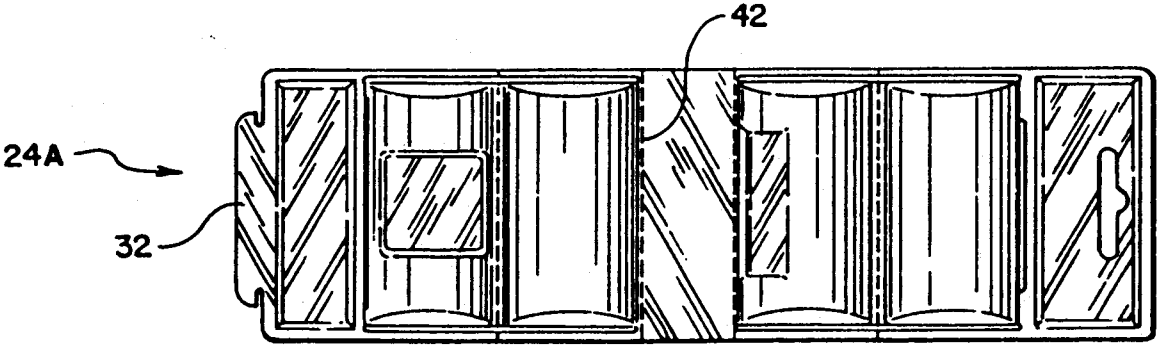
FIG. 6 is a bottom view of the package shown in FIG. 4.

The support portion 22 includes an interconnecting portion 28, formed by a pair of similarly shaped, planar intermediate portions of the plastic shells 24A, 24B which are secured in superposed relation to one another, and a retaining portion 30. The retaining portion 30 includes a tab portion 32 formed at one end of the front package portion 14 by the superposed end portions of the plastic shells 24A, 24B, and a slot 34 formed at the other end of rear package portion 18, as best shown in FIGS. 5 and 6. The slot 34 is formed by a pair of identically configured and aligned formed in the plastic shells 24A, 24B.

Figure 1:
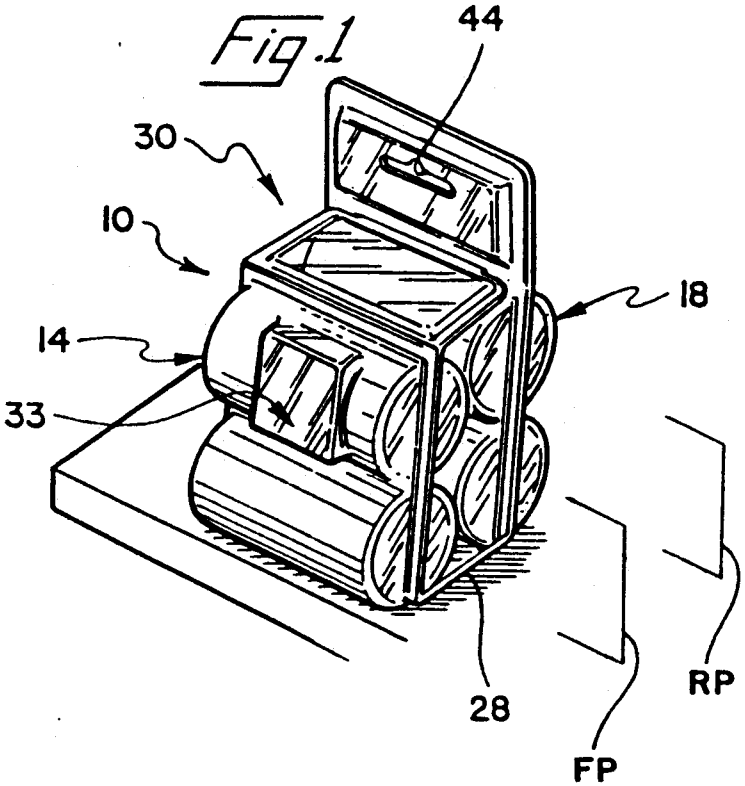
FIG. 1 is a perspective view of one preferred embodiment of the package of the present invention, showing the package disposed in a self-standing upright position on a surface.
Figure 4:
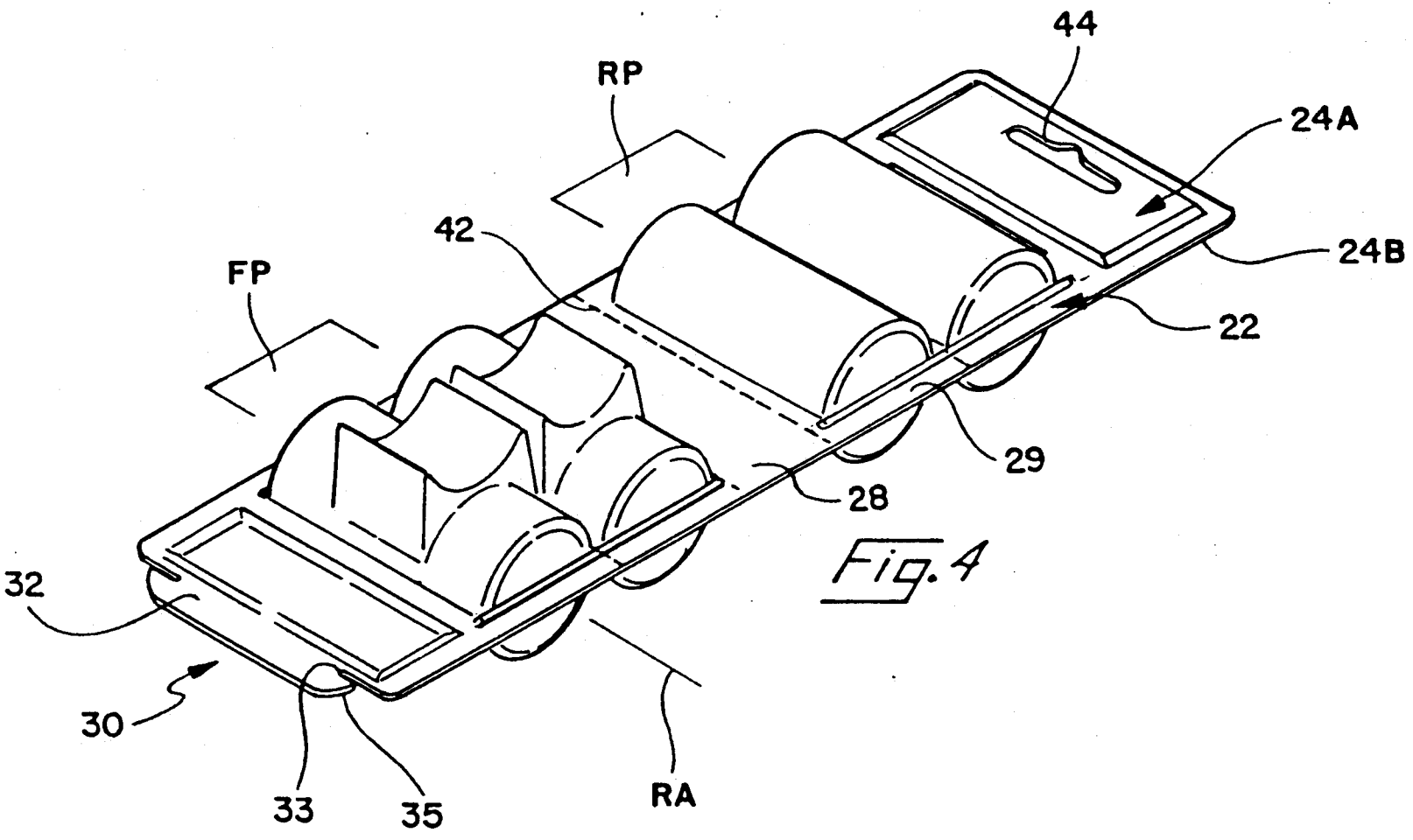
FIG. 4 is a perspective view of the package shown in FIG. 1, showing the package in its item access disposition.

As seen in FIGS. 4 and 7, the item receptacles 16, 20 are identically configured in the form of a tubular compartment having a receptacle axis RA. As shown in FIGS. 1 and 3, the receptacle axes RA of the item receptacle 16 of the front package portion 14 define a front package plane FP and the receptacle axes RA of the item receptacles 20 of the rear package portion 18 define a rear package plane RP. The axial length of each compartment is slightly greater than the axial length of the respective one of the items 12 retained therein and the cross sectional area of each compartment, as measured transversely to the receptacle axis RA, is slightly greater than the diameter of the item 12 retained in the compartment. Accordingly, each item 12 is retained in a respective item receptacle 16, 20 with its axial extent generally aligned with the receptacle axis RA of the respective item receptacle.

As best shown in FIG. 3, the item receptacles 16 of the front package portion 14 each include alignment legs 36 formed on the plastic shell 24B to define an alignment contour therebetween which is dimensioned in correspondence with the outer surfaces of the particular item receptacle 20 of the rear package portion 18 which is positioned adjacent the alignment legs 36 in the display disposition of the package 10, such legs serving to stabilize the package in a manner to be described presently. Additionally, one of the item receptacles 16 includes a display material window portion 38 formed on the plastic shell 24A thereof, which will also be described in greater detail below.

The item receptacle 20 of the rear package portion 18 which is most closely adjacent the interconnecting portion 28, is provided with a stabilizing leg portion 40 which is formed on the plastic shell 24B. The stabilizing leg portion 40 is in the shape of a generally triangular prism and is integrally formed with the respective item receptacle 20.

As shown in FIGS. 2 and 4–7, the package 10 further includes a plurality of linear perforations 42 formed in the plastic shells 24A, 24B, each linear perforation 42 being disposed intermediate an adjacent pair of item receptacles 16, 20 and extending generally parallel to the receptacle axes RA of the adjacent pair of item receptacles. The linear perforations 42 can be formed in the plastic shells 24A, 24B prior to their assembly or they can be formed in the assembled plastic shells in any conventional manner.

As explained more fully hereafter, the package 10 is adapted to be movable between predetermined positions and, to this end, the package 10 additionally includes a pair of parallel bending channels formed in the interconnecting portion 28 and a bending channel formed at the interface between the tab portion 32 and the front package portion 14. The bending channels extend laterally and act to reduce the effective cross-sectional extent of the package 10 at those channel locations so that the package can be more easily bent or folded along the channel locations.

To configure the package 10 for its display disposition for retaining a plurality of the items 12 in separated disposition from one another, the tab portion 32 of the front package portion 14 is inserted into the slot 34 such that a portion of the tab portion 32 extends through the slot 34. To preclude the tab portion 32 from withdrawing from the slot means 34, the tab portion 32 includes a pair of notches 33 which define a pair of ears 35 at the free end of the tab portion 32. The ears 35 are each adapted to extend slightly beyond one respective end of the slot 34 to resist withdrawal of the tab portion 32 from the slot 34.

The disposition of the tab portion 32 in the slot 34 in the display disposition of the package 10 effects alignment of the item receptacle 16 of the front package portion 14 with the item receptacles 20 of the rear package portion 18. Specifically, the front package portion 14 and the rear package portion 18 each pivot with respect to the interconnecting portion 28 until the notches 33 in the tab portion 32 are engaged by the slot 34. By appropriately dimensioning the extent of the tab portion between its bending channel connection with the front package portion 14 and its notches 33 with respect to the interconnecting portion 28, the engagement of the tab portion 32 and the slot means 34 will insure that the plane FP of the front package portion 14 is aligned generally parallel to the plane RP of the rear package portion 18, and with side edges of the shells 24A and 24B forming a parallelogram as best seen in FIG. 3.

In practice, it has been found that the package 10 inclines slightly from the vertical when it is positioned in the self-standing configuration. As best seen in FIG. 3, the slight inclination of the package results in a side profile in which the border portions 29 define a non-right angled parallelogram and in a support arrangement in which the alignment legs 36, the support portion 22 and the stabilizing leg 40 cooperate together to provide the package 10 with its self-standing capability.

Figure 2:
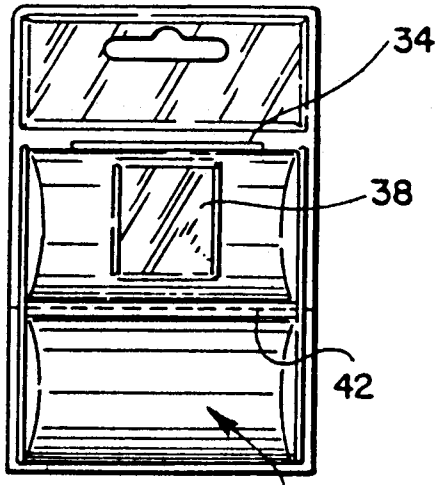
FIG. 2 is a front elevational view of the package shown in FIG. 1.

As shown in FIGS. 1 and 2, the package 10 additionally includes a hanging slot 44 for suspending the package in its display disposition from a hanging rod of a conventional retail display (not shown). Alternatively, as best seen in FIGS. 1 and 3, the package 10 is adapted to be self-standing in its display disposition when placed on a table or other surface. In this configuration, the alignment legs 36 engage the outer surfaces of those item receptacles 20 of the rear package portion 18 which are positioned adjacent the alignment legs to stabilize the front package portion 14 with respect to the rear package portion 18, and the stabilizing leg portion 40 rests on the table or other surface to additionally stabilize the package 10. As can be seen in FIG. 1, the tab portion 32 of the front package portion 14 is advantageously positioned in the self-standing configuration of the package 10, for displaying advertising or trademarks associated with the items 12 retained by the package 10.

To reconfigure the package 10 from its display disposition to its item access disposition in which the items 12 can be selectively and individually removed from the package 10, the tab portion 32 is withdrawn from the slot 34 and the front package portion 14 and the rear package portion 18 are pivoted until the plane FP of the front package portion 14 and the rear plane RP of the rear package portion 18 are brought into generally coplanar alignment with one another, as shown in FIG. 4. Thereafter, each item receptacle 16, 20 can be removed by tearing of the package 10 along the perforation 42, as shown in FIG. 7.

As seen in FIG. 7, the linear perforations 42 permit each item receptacle 16, 20 to be detached from the adjacent item receptacles for permitting access to the item 12 retained in the respective detached item receptacle. The superposed portions of the engagement faces 26A, 26B of the shells 24A, 24B which extend between the adjacent pairs of the item receptacles 16, 20 and in which the linear perforations 42 are formed, can either be left in unattached relation to one another or can be secured to one another by conventional means such as, for example, heat sealing. If the superposed portions of the shells 24A, 24B remain in their unattached relation to one another when an item receptacle 16, 20 is detached along the respective linear perforation 42, access to the item 12 in each of the two previously adjacent item receptacles can be readily obtained by widening the gap between the superposed, unattached portions of the engagement faces 26A, 26B of the shells 24A, 24B. For example, the engagement faces 26A, 26B can be separated from one another to break the heat sealing of their border portions to an extent sufficient to allow the removal of the item 12 within each of the two previously adjacent item receptacles. Alternatively, the linear perforations 42 can be located immediately adjacent the respective spaced recesses 27A, 27B of each item receptacle 16, 20, so that the detachment of a respective item receptacle 16, 20 from one of its neighboring item receptacles by tearing along the respective linear perforation 42 will simultaneously separate the respective item receptacle from its neighboring item receptacle and provide an access opening between the recesses 27A, 27B of the respective item receptacle for removal of the item 12 therein. If the superposed portions of the shell 24A, 24B remain adhesively or otherwise secured to one another following the detachment of the respective item receptacle 16, 20 from one of its neighboring item receptacles, the item 12 can be removed from the detached item receptacle by, for example, cutting the respective item receptacle with a knife or other sharp object at the time that the user desires to remove the item 12 therein.

Figure 10:
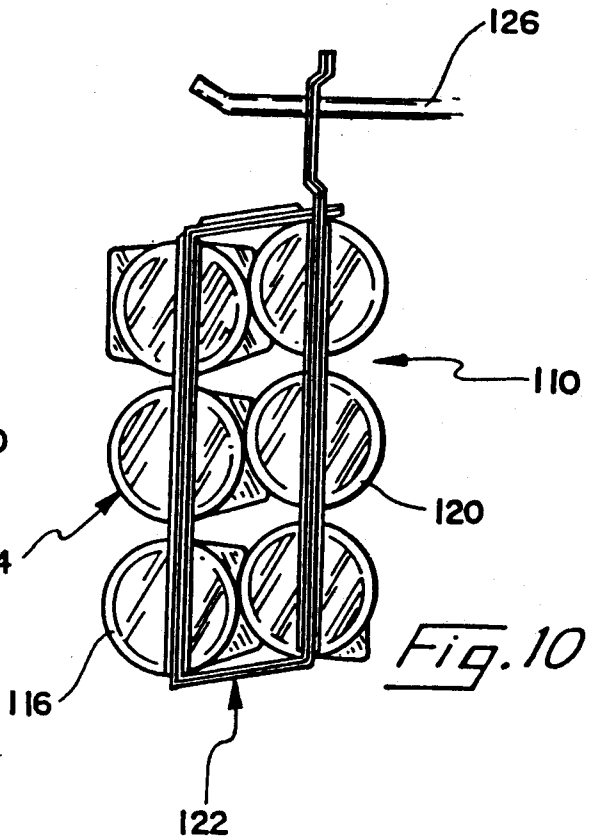
FIG. 10 is a side elevational view of the package shown in FIG. 8.
Figure 9:
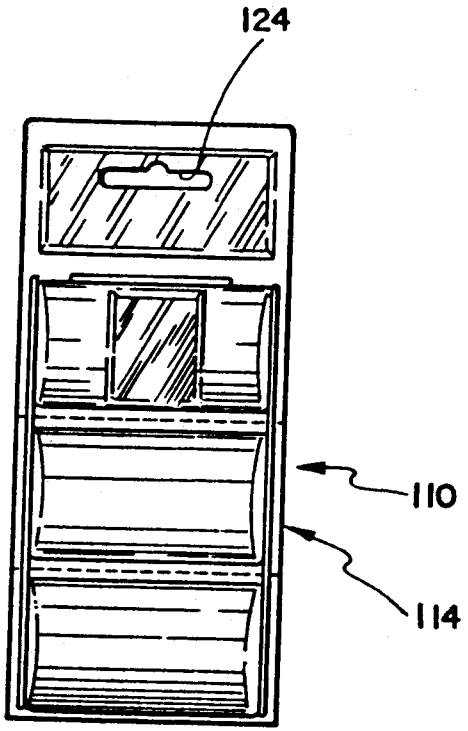
FIG. 9 is a front elevational view of the package shown in FIG. 8.
Figure 8:
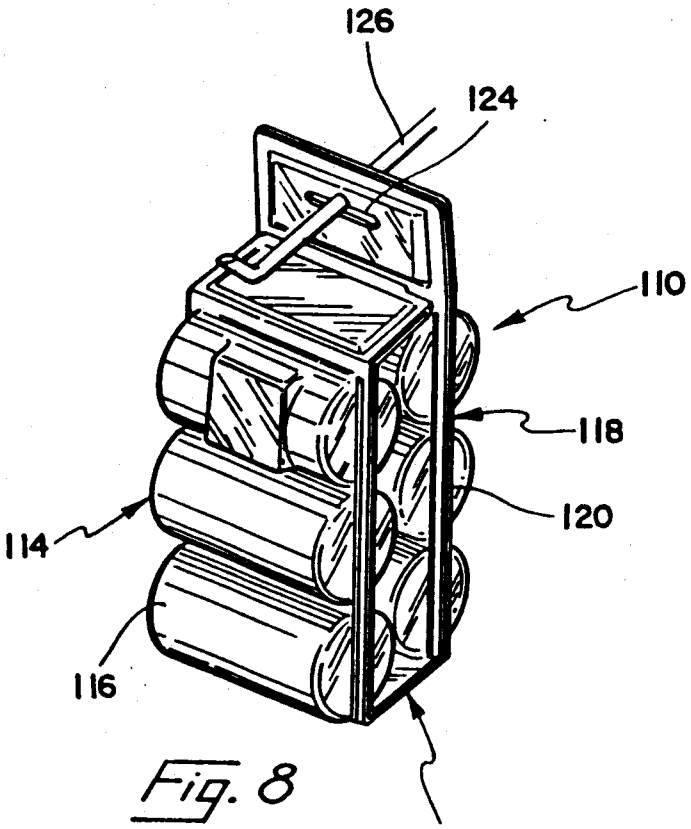
FIG. 8 is a perspective view of another embodiment of the package of the present invention, showing the package in its display disposition and supported on a conventional display rack.

In FIGS. 8–10, another embodiment of a package constructed in accordance with the present invention is illustrated and is generally designated as 110. The package 110 includes a front package portion 114, a rear package portion 118 and a support portion 122 for connecting the front package portion 114 and the rear package portion 118 to one another. The package 110 is similarly configured to the package 10 described with respect to FIGS. 1–7 except that the package 110 includes a pair of additional discrete item receptacles, a respective one being located in its front package portion 114 and the other being located in its rear package portion 118. Thus, the front package portion 114 includes three discrete item receptacles 116 and the rear package portion 118 includes three discrete item receptacles 120, each item receptacle 116, 120 retaining one of the items 12 in a predetermined orientation with respect to the item receptacle and the other retained items and in a separate disposition from the items retained by the other item receptacles.

The package 110 includes a hanging slot 124 for suspending the package 110 from a hanging rod 126 of a conventional retail display rack (not shown). As best seen in FIG. 10, the front package portion 114 and the rear package portion 118 are maintained by the support means 122 in generally superposed, adjacent relation with one another with the retained items generally aligned with one another when the package 110 is suspended from the hanging rod 126 in its storage disposition.

Figure 12:
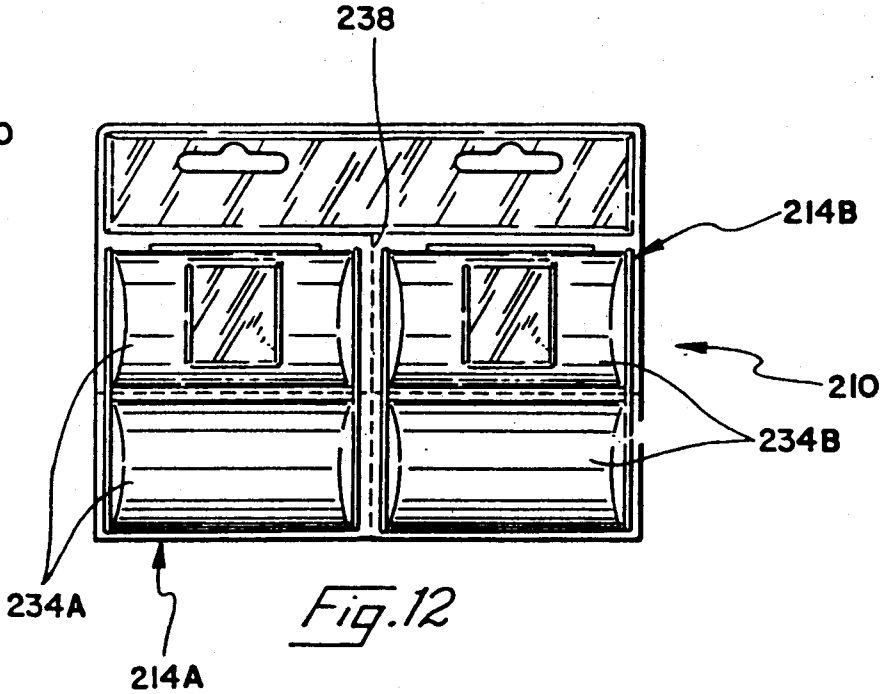
FIG. 12 is a front elevational view of the package shown in FIG. 11.
Figure 11:
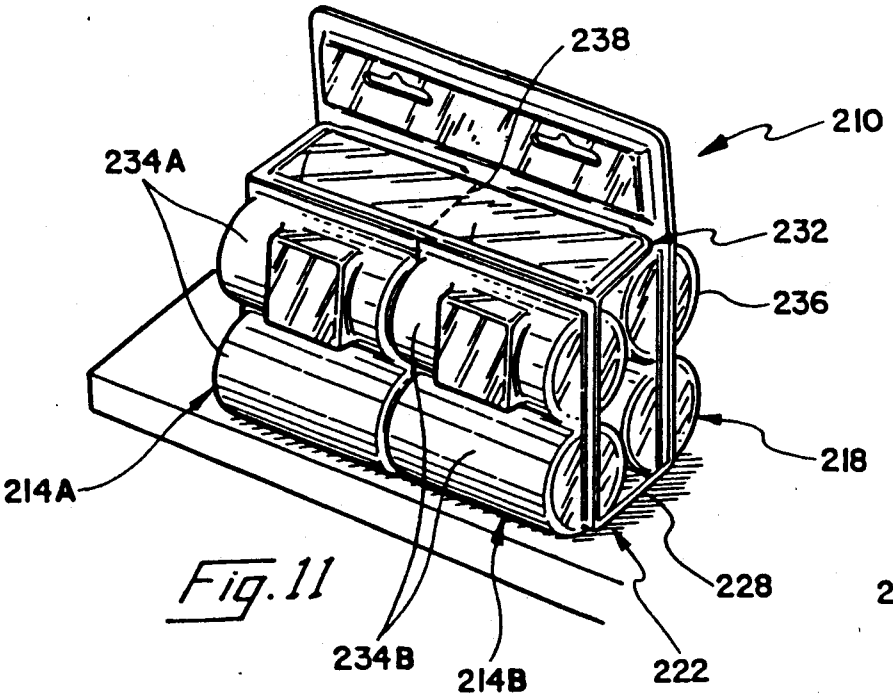
FIG. 11 is a perspective view of yet another embodiment of the package of the present invention.

In FIGS. 11 and 12, another embodiment of a package constructed according to the present invention is illustrated and is generally designated as 210. The package 210 is basically a single unit comprising a pair of the packages 10 described in the embodiment in FIGS. 1–7, secured and adapted to retain a plurality of items 212 in separated, aligned disposition in side-by-side relation with one another. Accordingly, the package 210 includes a pair of front package portions 214A, 214B and a rear package portion 218. The front package portion 214A, 214B are connected by a support portion 222 to one another and to the rear package portion 218. The support portion 222 includes an interconnecting portion 228 and a tab portion 232. The front package portions 214A, 214B each include a pair of item receptacles 234A, 234B, respectively, each item receptacle for individually retaining one of the items 212. Each item receptacle 234A, 234B is cylindrical in shape and the cylindrical axis of the receptacles is aligned parallel to the other axis of the other receptacle of the respective front package portion 214A, 214B and coplanar in a plane FP with all the cylindrical axes. The rear package portion 218 includes four item receptacles 236, each for individually retaining one of the items 212 and each being cylindrical in shape with the cylindrical axes of the item receptacles 236 being arranged coplanar with one another in a plane RP. The package 210 includes a perforation 238 extending through the tab portion 232 and from the tab portion to and through the interconnecting portion 228 for permitting the front package portions 214A, 214B to be independently moved between a display disposition in which the tab portion 232 is engaged with the rear package portion 218 and an item access disposition in which the plane FP of the front package portions 214A, 214B is generally coplanar with the plane RP of the rear package portion 218 for removing the items 212 stored in the item receptacles of the package 210.

Accordingly, the present invention provides a package which is configurable into an attractive display disposition in which the package can be readily deployed in a free standing arrangement on a retail shelf or the like or can be hung from a retail display rack. Moreover, the novel manner in which the package of the present invention retains items makes the package particularly well suited for the packaging of certain products such as, for example, cylindrical batteries. Specifically since the package of the present invention retains cylindrical items with their axes at a horizontal orientation in the display position, a consumer can easily read any lettering and/or artwork extending longitudinally along the outer surface of the cylindrical item. This assures the item manufactures that their trademarks or other important information can be easily read through the clear plastic package merely by insuring that such trademarks or other information is printed longitudinally along the outer surface of the cylinder. Similarly, the package of the present invention advantageously provides a display material window for including additional printed material which a potential consumer can readily read when viewing the package in its display position.

The package of the present invention provides additional benefits in that the package can be preconfigured in its display position before shipment to a retailer so that the retailer need only remove the packages from the shipping container and arrange the packages on a retail shelf, rack or the like without the need for any further manipulation of the package. Similarly, the package of the present invention offers advantages over some known containers such as, for example, containers comprising a blister pack portion surrounded by cardboard trim. Since the package of the present invention provides ample room for graphics and the like while minimizing the side to side extent of the package, a plurality of the packages of the present invention can often be packed together more closely than such certain known containers, thereby producing a desirable reduction in the shipping cubic volume.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A package for retaining and displaying a plurality of cylindrical batteries in separated compartments, comprising:

a front package portion having a plurality of cylindrical discrete item receptacles;

a rear package portion having a plurality of cylindrical discrete item receptacles, each cylindrical item receptacle of said front and rear package portions having a longitudinal axis and being adapted for independently retaining one of the cylindrical batteries therein with the axis of the cylindrical battery generally parallel with the axis of the said cylindrical item receptacle in which it is retained, said cylindrical item receptacles of said front package portion being arranged relative to one another with their longitudinal axes substantially parallel to define a first plane and said cylindrical item receptacles of said rear package portion being arranged relative to one another with their longitudinal axes substantially parallel to define a second plane;

interconnecting means for interconnecting one end of said front package portion to one end of said rear package portion;

retaining means for retaining said front and rear package portions in a preferred disposition, said retaining means including a slot means formed in the other end of said front package portion for receiving a tab portion therein and a tab portion formed at the other end of said rear package portion, said tab portion being selectively insertable into said slot means; and said interconnecting means permitting relative movement between said front package portion and said rear package portion between a first display position in which said first and second planes are substantially parallel to one another and said tab portion is inserted into said slot means to maintain said front and rear receptacles at said first display position, and a second access position in which said first and second planes are substantially co-planar, said cylindrical item receptacles of said front and rear package portions being readily accessible in said second access position for removing the cylindrical batteries.

2. A package for retaining and displaying a plurality of cylindrically-shaped batteries to be retained and displayed in separated compartments, comprising:

a pair of plastic shells adapted to be cooperatively engaged with one another, said plastic shells forming, in their cooperatively engaged disposition;

a front item receptacle having a plurality of cylindrical discrete item retaining portions each having a longitudinal axis and being adapted for retaining a cylindrical battery therein with the axis of the cylindrical battery being generally parallel with the axis of the cylindrical discrete item retaining portion and said cylindrical discrete item retaining portions being arranged relative to one another with their longitudinal axes substantially parallel to define a first plane;

a rear item receptacle having a plurality of cylindrical discrete item retaining portions each having a longitudinal axis and being adapted for retaining a cylindrical battery therein with the axis of the cylindrical battery being generally parallel with the axis of the cylindrical discrete item retaining portion and said cylindrical discrete item retaining portions being arranged relative to one another with their longitudinal axes substantially parallel to define a second plane;

means interconnecting said front and rear item receptacles, the interconnecting means permitting predetermined movement of said front and rear receptacle relative to one another between a first display position in which said receptacles are disposed in generally superposed, adjacent relation to one another with said first and second planes being substantially parallel to one another and a second access position in which said receptacles are substantially displaced from one another to permit ready access to both said front and rear receptacles, each said front and rear receptacle being formed to support and retain an item received therein independently of the other receptacle at said first display position and during said predetermined movement between said first display position and said second access position;

retaining means for selectively maintaining said front and rear receptacles at said first display position; and means for securing said plastic shells to one another in said cooperatively engaged disposition thereof.

3. A package according to claim 2 and characterized further in that said retaining means includes a tab portion and a slot means for releasably securing said tab portion when said tab portion is inserted therein, said tab portion being selectively insertable into said slot means to selectively maintain said front and rear receptacles at said first display position.

4. A package according to claim 2 and characterized further by a plurality of perforations for permitting detachment of said front item receptacle from said rear item receptacle, said perforations being disposed between said front and rear item receptacles.

5. A package according to claim 2 and characterized further in that said pair of plastic shells define a hang slot for hanging the package from a retail display rack.

6. A package according to claim 2 and characterized further in that said interconnecting means includes a generally planar portion adapted to rest on a surface, said generally planar portion cooperating with said retaining means to permit the package to be generally self-standing on a flat surface.

7. A package according to claim 6 and characterized further by a stabilizing leg portion formed on said rear item receptacle for stabilizing the package when it is at said self-standing position thereof.

8. A package according to claim 2 and characterized further in that a selected one of said front item receptacle and said rear item receptacle includes an alignment leg for engaging the outer periphery of the other of said selected front item receptacle and said rear item receptacle to enhance the stability of the package in its said first display position.

9. A package according to claim 2 and characterized further in that the edges of said pair of shells and the edges of said interconnecting means and said retaining means form a parallelogram when said front and rear receptacles are disposed in said first display position.

* * * * *